US012384602B2

(12) United States Patent
Haumont

(10) Patent No.: US 12,384,602 B2
(45) Date of Patent: Aug. 12, 2025

(54) SCREWCAP AND BOTTLE ASSEMBLY

(71) Applicant: AMCOR FLEXIBLES NORTH AMERICA, INC., Neenah, WI (US)

(72) Inventor: Paul Haumont, Dijon (FR)

(73) Assignee: AMCOR FLEXIBLES NORTH AMERICA, INC., Neenah, WI (US)

( * ) Notice: Subject to any disclaimer, the term of this patent is extended or adjusted under 35 U.S.C. 154(b) by 0 days.

(21) Appl. No.: 18/570,017

(22) PCT Filed: Jun. 28, 2021

(86) PCT No.: PCT/US2021/039397

§ 371 (c)(1),
(2) Date: Dec. 13, 2023

(87) PCT Pub. No.: WO2023/277864

PCT Pub. Date: Jan. 5, 2023

(65) Prior Publication Data

US 2024/0278959 A1 Aug. 22, 2024

(51) Int. Cl.
*B65D 41/34* (2006.01)
*B65D 1/02* (2006.01)

(52) U.S. Cl.
CPC ..... *B65D 41/3428* (2013.01); *B65D 1/0246* (2013.01)

(58) Field of Classification Search
CPC ..... B65D 41/3428; B65D 41/348; B65D 41/045; B65D 41/08; B65D 41/0435;

(Continued)

(56) References Cited

U.S. PATENT DOCUMENTS 1,771,034 A * 7/1930 Fabrice ..... B65D 41/3485 215/256
2,175,350 A * 10/1939 Hammer ..... B65D 41/348 215/325

(Continued)

FOREIGN PATENT DOCUMENTS

BE 378557 A 1/1948
CH 691587 A5 8/2001

(Continued)

OTHER PUBLICATIONS

PCT International Search Report, International Application No. PCT/US2021/039397, issued Oct. 21, 2021, 2 pages.

*Primary Examiner* — Orlando E Aviles
*Assistant Examiner* — Brijesh V. Patel

(57) ABSTRACT

A screwcap and a bottle assembly are disclosed. The screwcap seals a neck of a bottle. The screwcap includes a shell extending along a longitudinal axis and configured to be disposed on the neck. The shell includes a head, and a skirt having a nominal outer diameter and detachable connected to the head along a bridge line. The skirt includes a first support ring disposed proximal to the bridge line, a second support ring disposed distal to the bridge line, and a third support ring disposed between the first support ring and the second support ring relative to the longitudinal axis. The first support has a first maximum outer diameter greater than the nominal outer diameter. The second support ring has a second maximum outer diameter greater than the nominal outer diameter. The third support ring has a third maximum outer diameter greater than the nominal outer diameter.

19 Claims, 8 Drawing Sheets

(58) Field of Classification Search

CPC ..... B65D 41/04; B65D 41/0414; B65D 41/0421; B65D 41/0442; B65D 41/34; B65D 41/58; B65D 41/62; B65D 1/0246; B65D 1/0207; B65D 1/023; B65D 1/46; B65D 1/48; B65D 2251/0078; B65D 2251/0015; B65D 2251/0028; B65D 23/00; B65D 2543/00092; B65D 2543/00296; B65D 2543/00518; B65D 51/04; B65D 51/18; B65D 51/185; B65D 51/245; B65D 53/02; B65D 53/04; B65D 7/04; B65D 7/38; B65D 7/48

USPC ..... 215/252–253, 320, 325, 341, 343–344, 215/349–350, 354, 43–44, 256, 258, 230, 215/270, 277; 220/266, 319, 288, 906; 277/637

See application file for complete search history.

(56) References Cited

U.S. PATENT DOCUMENTS

| | | | | | |
|---|---|---|---|---|---|
| 2,280,724 | A * | 4/1942 | Sharp | B65D 41/348 | 215/252 |
| 2,367,317 | A * | 1/1945 | Thomas | B65D 41/348 | 53/488 |
| 3,001,657 | A * | 9/1961 | Gamble | B65D 41/34 | 413/23 |
| 3,335,889 | A * | 8/1967 | Brumme | B65D 41/46 | 215/253 |
| 3,348,718 | A * | 10/1967 | Musy | B65D 41/348 | 215/252 |
| 3,455,479 | A * | 7/1969 | Ronald | B65D 41/348 | D9/453 |
| 3,713,545 | A * | 1/1973 | Lawrence | B65D 41/045 | 215/260 |
| 3,930,588 | A * | 1/1976 | Coursaut | B65D 41/348 | 215/253 |
| 3,940,005 | A * | 2/1976 | Granat | B65D 41/28 | 215/354 |
| 3,995,762 | A * | 12/1976 | Pfefferkorn | B65D 41/58 | 215/256 |
| 4,474,302 | A * | 10/1984 | Goldberg | B65D 41/48 | 215/256 |
| 4,583,652 | A * | 4/1986 | Goldberg | B65D 55/16 | 215/256 |
| 4,628,669 | A | 12/1986 | Herron et al. | | |
| 5,445,284 | A | 8/1995 | Guest | | |
| 6,010,026 | A * | 1/2000 | Diekhoff | B21D 51/40 | 215/44 |
| 6,403,173 | B1 * | 6/2002 | Granger | B65D 41/0492 | 215/252 |
| 6,817,479 | B1 | 11/2004 | Ferry et al. | | |
| 7,121,419 | B2 * | 10/2006 | Ferry | B65D 49/06 | 215/258 |
| 8,231,019 | B2 * | 7/2012 | Battegazzore | B65D 41/0492 | 215/253 |
| 8,453,857 | B2 * | 6/2013 | Battegazzore | B65D 41/348 | 220/319 |
| 8,689,990 | B2 * | 4/2014 | Hdeyasu | B65D 41/045 | 215/350 |
| 9,139,324 | B1 * | 9/2015 | Watkins | B65D 1/0207 | |
| 9,981,781 | B2 * | 5/2018 | Kurmis | B65D 41/348 | |
| 10,106,298 | B2 * | 10/2018 | Watkins | B65D 23/00 | |
| 2003/0021919 | A1 * | 1/2003 | Granger | B65D 41/0428 | 428/34.1 |
| 2003/0116521 | A1 * | 6/2003 | Chupak | B65D 1/0246 | 215/44 |
| 2005/0211657 | A1 * | 9/2005 | Mallet | B65D 41/3428 | 215/349 |
| 2007/0138125 | A1 * | 6/2007 | Granger | B65D 41/348 | 215/349 |
| 2008/0011706 | A1 * | 1/2008 | Downing | B65D 1/0246 | 215/256 |
| 2010/0065528 | A1 * | 3/2010 | Hanafusa | B65D 41/045 | 215/349 |
| 2010/0163511 | A1 * | 7/2010 | Cappello | B65D 51/1616 | 215/341 |
| 2011/0036839 | A1 * | 2/2011 | Gardner | B65D 41/045 | 53/317 |
| 2011/0253666 | A1 * | 10/2011 | Keller | B65D 41/045 | 215/350 |
| 2016/0068311 | A1 * | 3/2016 | McPherson | B65D 41/348 | 220/214 |
| 2017/0101227 | A1 * | 4/2017 | Aagaard | B29C 66/7422 | |
| 2017/0137188 | A1 * | 5/2017 | Tsuchiya | B29C 43/003 | |
| 2017/0283127 | A1 | 10/2017 | Watkins et al. | | |
| 2021/0147121 | A1 * | 5/2021 | Fujishige | B65D 41/3428 | |

FOREIGN PATENT DOCUMENTS

| | | | | | |
|---|---|---|---|---|---|
| DE | 202014100255 | U1 | | 4/2015 | |
| EP | 0673850 | B1 | | 7/1997 | |
| EP | 3409609 | A1 | | 12/2018 | |
| GB | 2081236 | B | * | 5/1984 | B65D 41/348 |
| WO | 9420237 | A1 | | 9/1994 | |
| WO | 199420237 | A1 | | 9/1994 | |
| WO | WO-0051904 | A1 | * | 9/2000 | B65D 41/045 |
| WO | WO-0242172 | A1 | * | 5/2002 | B65D 41/34 |
| WO | WO-2009013604 | A1 | * | 1/2009 | B65D 41/3438 |

* cited by examiner

SCREWCAP AND BOTTLE ASSEMBLY

TECHNICAL FIELD

The present application relates generally to a screwcap and a bottle assembly, and in particular to a screwcap for sealing a neck of a bottle, and a bottle assembly including the screwcap.

BACKGROUND

Screwcaps are generally used to seal a bottle. However, conventional screwcaps may undergo distortion during a capping process and experience various defects due to the distortion. In some cases, the defects may result in leakage of a product stored in the bottle. Further, the defects may cause the product stored in the bottle to deteriorate. In some other cases, the defects may result in undesired pull-offs of the conventional screwcaps from the bottle. Thus, the defects may also promote tampering of the product stored in the bottle. Moreover, the defects may negatively affect an appearance of the bottle.

SUMMARY

A screwcap for sealing a neck of a bottle has been developed. The screwcap may reduce or eliminate various defects that may occur during a capping process. Further, the screwcap may improve an appearance of the bottle after the capping process.

One embodiment of the present disclosure is a screwcap for sealing a neck of a bottle. The screwcap includes a shell extending along a longitudinal axis and configured to be disposed on the neck. The shell includes a head. The shell further includes a skirt having a nominal outer diameter and detachably connected to the head along a bridge line. The skirt includes a first support ring disposed proximal to the bridge line. The first support ring has a first maximum outer diameter greater than the nominal outer diameter of the skirt. The skirt further includes a second support ring disposed distal to the bridge line. The second support ring has a second maximum outer diameter greater than the nominal outer diameter of the skirt. The skirt further includes a third support ring disposed between the first support ring and the second support ring relative to the longitudinal axis. The third support ring has a third maximum outer diameter greater than the nominal outer diameter of the skirt.

The first support ring may be configured to protect the bridge line during crimping of the shell. The second support ring may be configured to improve an appearance of the screwcap after crimping of the shell.

The third support ring may reduce distortion of the first and second support rings during crimping of the shell to the neck of the bottle. Therefore, the third support ring may prevent various defects, such as bird beaks and facets, that may occur during the capping process.

The third support ring may allow improved crimping of the shell to the neck of the bottle, thereby enhancing securement of the screwcap with the bottle. Specifically, the third support ring may enable reduction of a crimped diameter of the shell on the neck. Thus, the third support ring may prevent undesired pull-offs of the screwcap from the bottle.

The third support ring may further allow lowering a position of the second support ring, thereby increasing a distance between the first support ring and the second support ring along the longitudinal axis. This may further reduce distortion of the second support ring during crimping of the shell. Moreover, the third support ring may not be visible after crimping. Consequently, the screwcap may improve an appearance of the bottle after the capping process.

In some embodiments, the first support ring includes a first peak having the first maximum outer diameter. The second support ring includes a second peak having the second maximum outer diameter. The third support ring includes a third peak having the third maximum outer diameter. A first distance between the first peak and the third peak is less than a second distance between the second peak and the third peak.

In some embodiments, the second distance is greater than the first distance by a factor of at least 1.3.

In some embodiments, the first distance is about 3 millimeters (mm), and the second distance is about 4 mm.

In some embodiments, the first support ring further includes a first proximal end proximal to the bridge line and having a first minimum outer diameter of the first support ring. The first support ring further includes a first distal end distal to the bridge line and having the first minimum outer diameter of the first support ring. The first peak is disposed between the first proximal end and the first distal end along the longitudinal axis. A first proximal peak distance between the first proximal end and the first peak along the longitudinal axis is greater than a first distal peak distance between the first distal end and the first peak along the longitudinal axis.

In some embodiments, the first proximal peak distance is greater than the first distal peak distance by a factor of at least about 1.3.

In some embodiments, the second support ring further includes a second proximal end proximal to the bridge line and having a second minimum outer diameter of the second support ring. The second support ring further includes a second distal end distal to the bridge line and having the second minimum outer diameter of the second support ring. The second peak is disposed between the second proximal end and the second distal end along the longitudinal axis. A second proximal peak distance between the second proximal end and the second peak along the longitudinal axis is less than a second distal peak distance between the second distal end and the second peak along the longitudinal axis.

In some embodiments, the second distal peak distance is greater than the second proximal peak distance by a factor of at least about 1.9.

In some embodiments, the third support ring further includes a third proximal end proximal to the bridge line and having a third minimum outer diameter of the third support ring. The third support ring further includes a third distal end distal to the bridge line and having the third minimum outer diameter of the third support ring. The third peak is disposed between the third proximal end and the third distal end along the longitudinal axis. A third proximal peak distance between the third proximal end and the third peak along the longitudinal axis is substantially equal to a third distal peak distance between the third distal end and the third peak along the longitudinal axis.

In some embodiments, the third maximum outer diameter is greater than the nominal outer diameter by at least 0.5 mm.

In some embodiments, the first maximum outer diameter, the second maximum outer diameter, and the third maximum outer diameter are substantially equal to one another.

In some embodiments, the first support ring has a first length along the longitudinal axis. The second support ring has a second length along the longitudinal axis. The third support ring has a third length along the longitudinal axis. The third length is less than each of the first length and the second length.

In some embodiments, the first length is greater than the third length by a factor of at least 1.16.

In some embodiments, the second length is greater than the third length by a factor of at least 1.45.

In some embodiments, the first length is about 2.8 mm, the second length is about 3.5 mm, and the third length is about 2.4 mm.

In some embodiments, the third support ring has a symmetric shape along the longitudinal axis.

In some embodiments, the third support ring has a V-shaped cross-section along the longitudinal axis.

In some embodiments, each of the first and second support rings has a curved cross-sectional shape.

In some cases, the second support ring may have an asymmetric cross-sectional shape along the longitudinal axis. The asymmetric cross-sectional shape of the second support ring may provide increased rigidity to the second support ring during crimping.

In some embodiments, at least a portion of the third support ring is configured to deform and engage a shoulder of the neck after crimping.

In some embodiments, the shell has an average thickness of about 0.25 mm.

In some embodiments, the head of the screwcap includes at least one internal thread configured to engage with at least one external thread of the neck of the bottle.

In some embodiments, the screwcap further including an insert disposed between the shell and the neck. The insert includes at least one internal thread configured to engage with at least one external thread of the neck.

In some embodiments, the screwcap further including a plurality of bridges disposed along the bridge line and detachably connecting the head to the skirt. The plurality of bridges defines a plurality of perforations therebetween.

As discussed above, the third support ring may reduce distortion of the first support ring during crimping of the shell. Consequently, the third support ring may prevent breakage or rupture of the plurality of bridges disposed along the bridge line during crimping. Thus, the third support ring may prevent leakage of a product stored in the bottle.

In some embodiments, the screwcap further including a sealing arrangement disposed between the shell and the neck. The sealing arrangement is configured to seal an opening of the neck.

The sealing arrangement may provide an air-tight seal between the screwcap and the opening of the bottle.

Another embodiment of the present disclosure is a bottle assembly. The bottle assembly includes a bottle and the screwcap. The bottle includes a neck. The neck includes a shoulder and an opening. The shell is crimped to the neck, such that at least a portion of the third support ring deforms and engages the shoulder of the neck after crimping. The third support ring has a third maximum crimped outer diameter after crimping. The third maximum crimped outer diameter is less than the nominal outer diameter of the skirt.

The third support ring may reduce distortion of the first and second support rings during crimping of the shell to the neck of the bottle.

In some embodiments, the second support ring has a second maximum crimped outer diameter after crimping and a second minimum crimped outer diameter after crimping. A difference between the second maximum crimped outer diameter and the second minimum crimped outer diameter is less than about 0.25 mm.

In some embodiments, the first support ring has a first maximum crimped outer diameter after crimping. The first maximum crimped outer diameter is substantially equal to the first maximum outer diameter.

There are several other aspects of the present subject matter which may be embodied separately or together. These aspects may be employed alone or in combination with other aspects of the subject matter described herein, and the description of these aspects together is not intended to preclude the use of these aspects separately or the claiming of such aspects separately or in different combinations.

BRIEF DESCRIPTION OF THE DRAWINGS

The disclosure may be more completely understood in consideration of the following detailed description of various embodiments of the disclosure in connection with the accompanying drawings, in which.

The figures are not necessarily to scale. Like numbers used in the figures refer to like components. It will be understood, however, that the use of a number to refer to a component in a given figure is not intended to limit the component in another figure labeled with the same number.

Figure 1:
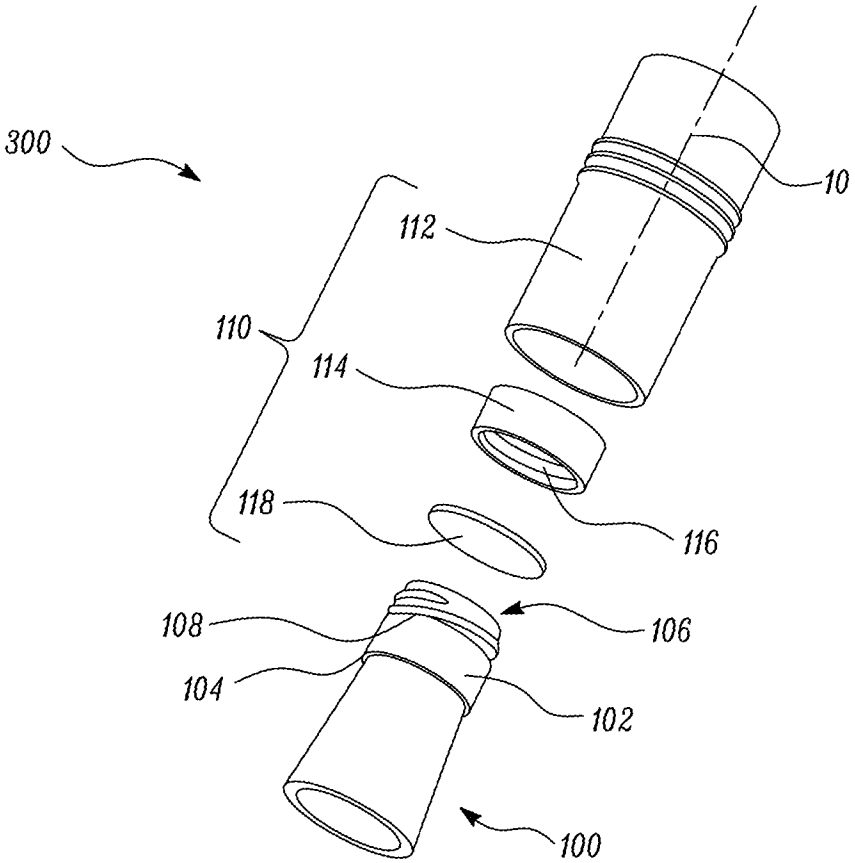
FIG. 1 illustrates a schematic exploded perspective view of a bottle assembly in accordance with an embodiment of the present disclosure.

The drawings show some but not all embodiments. The elements depicted in the drawings are illustrative and not necessarily to scale, and the same (or similar) reference numbers denote the same (or similar) features throughout the drawings.

DETAILED DESCRIPTION

The present disclosure relates to a screwcap for sealing a neck of a bottle. The screwcap may reduce or eliminate various defects that may occur during a capping process. Further, the screwcap may improve an appearance of the bottle after the capping process.

The screwcap includes a shell extending along a longitudinal axis and configured to be disposed on the neck. The shell includes a head. The shell further includes a skirt having a nominal outer diameter and detachably connected to the head along a bridge line. The skirt includes a first support ring disposed proximal to the bridge line. The first support ring has a first maximum outer diameter greater than the nominal outer diameter of the skirt. The skirt further includes a second support ring disposed distal to the bridge line. The second support ring has a second maximum outer diameter greater than the nominal outer diameter of the skirt. The skirt further includes a third support ring disposed between the first support ring and the second support ring relative to the longitudinal axis. The third support ring has a third maximum outer diameter greater than the nominal outer diameter of the skirt.

The first support ring may be configured to protect the bridge line during crimping of the shell. The second support ring may be configured to improve an appearance of the screwcap after crimping of the shell.

The third support ring may reduce distortion of the first and second support rings during crimping of the shell to the neck of the bottle. Therefore, the third support ring may prevent various defects, such as bird beaks and facets, that may occur during the capping process.

The third support ring may allow improved crimping of the neck to the shell of the bottle, thereby enhancing securement of the screwcap with the bottle. Specifically, the third support ring may enable reduction of a crimped diameter of the shell on the neck. Thus, the third support ring may prevent undesired pull-offs of the screwcap from the bottle.

The third support ring may further allow lowering a position of the second support ring, thereby increasing a distance between the first support ring and the second support ring along the longitudinal axis. This may further reduce distortion of the second support ring during crimping of the shell. Moreover, the third support ring may not be visible after crimping. Consequently, the screwcap may improve an appearance of the bottle after the capping process.

As used in the present application, the term "crimping" may refer to any suitable process of joining two parts by mechanically deforming one or both of the two parts to hold the other, and the term "crimp" may refer a region of deformation that may result from crimping.

As used in the present application, the term "bridge line" may refer to a line of weakness including continuous or non-continuous series of holes, vents, slits, slots, perforations, notches, punctures, orifices, openings, inlets, channels, etc., in the surface of or throughout a shell. Its depth may extend from a first surface of the shell to a second surface of the shell (i.e., throughout an entire thickness of the shell). Alternatively, its depth may extend from about 50% to about 95% of the thickness of a shell.

As used in the present application, the term "nominal outer diameter" may refer to a minimum outer diameter of a body prior to undergoing a metalworking process, such as crimping.

As used in the present application, the terms "circularity" or "roundness" may refer to a degree of deviation of an object from a geometrically perfect circle. The terms "circularity" or "roundness" may further refer to a tolerance zone defined between two concentric circles.

As used in the present application, the term "circularity rate" may refer to a difference between a maximum outer diameter and a minimum outer diameter of an object.

FIG. 1 shows a schematic exploded perspective view of a bottle assembly 300 in accordance with an embodiment of the present disclosure.

Bottle assembly 300 includes a bottle 100. Bottle 100 is partially shown in FIG. 1. Bottle 100 includes a neck 102. Neck 102 includes a shoulder 104 and an opening 106. Neck 102 further includes at least one external thread 108.

In some embodiments, bottle 100 may be made of glass. Bottle 100 may be used to store any suitable product. In some cases, bottle 100 may be used to store liquid products. For example, bottle 100 may be used to store alcoholic drinks, such as wines, aperitifs, liqueurs, and alcohols. In another example, bottle 100 may be used to store juices, carbonated drinks, and the like.

Bottle assembly 300 further includes a screwcap 110 for sealing neck 102 of bottle 100. Screwcap 110 includes a shell 112 extending along a longitudinal axis 10 and configured to be disposed on neck 102.

Shell 112 may be made from any suitable metal. In some embodiments, shell 112 may be made of aluminum. Shell 112 may be formed using a suitable drawing process, by drawing a sheet of metal into a cylindrical shape that is open on one side.

In the illustrated embodiment of FIG. 1, screwcap 110 further includes an insert 114 disposed between shell 112 and neck 102. In some embodiments, insert 114 includes at least one internal thread 116 configured to engage with at least one external thread 108 of neck 102. Insert 114 may be made of any suitable plastic, such as Polyethylene Terephthalate (PET), High-Density Polyethylene (HDPE), Polyvinyl Chloride (PVC), Polypropylene (PP), and the like.

In the illustrated embodiment of FIG. 1, screwcap 110 further includes a sealing arrangement 118 disposed between shell 112 and neck 102. In some embodiments, sealing arrangement 118 is configured to seal opening 106 of neck 102. In some embodiments, sealing arrangement 118 may facilitate providing an air-tight seal between neck 102 and screwcap 110 to seal opening 106. In some embodiments, sealing arrangement 118 may include a liner. In some embodiments, the liner of sealing arrangement 118 may be made from a composition including a thermoplastic elastomer, polyisobutylene, and polybutylene. In some other embodiments, the liner of sealing arrangement 118 may include a multilayer liner including a layer of expanded polyethylene (EPE), a layer of white kraft, a layer of tin, a layer of polyvinylidene chloride (PVDC), and the like.

Figure 2A:
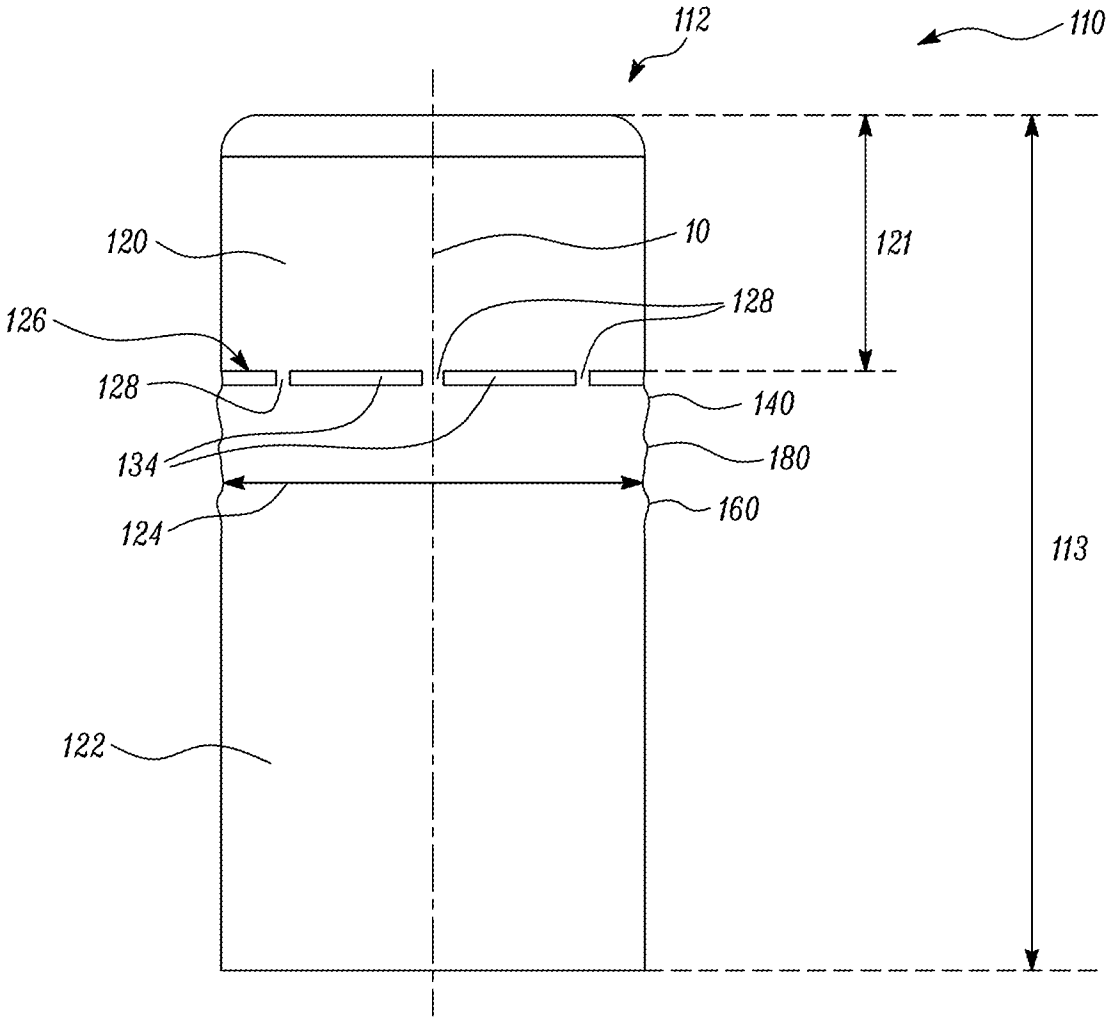
FIG. 2A illustrates a schematic front view of a screwcap in accordance with an embodiment of the present disclosure.

FIG. 2A shows a schematic front view of screwcap 110 in accordance with an embodiment of the present disclosure.

As shown in FIG. 2A, shell 112 has a shell length 113. Shell length 113 may depend upon design and dimensions of bottle 100 (shown in FIG. 1). Shell length 113 is measured along longitudinal axis 10. In some embodiments, shell length 113 may be from about 50 millimeters (mm) to about 70 mm. In some embodiments, shell length 113 may be about 60 mm.

Shell 112 includes a head 120. As shown in FIG. 2A, head 120 has a head length 121. Head length 121 is measured along longitudinal axis 10. Head length 121 may depend upon design and dimensions of neck 102 (shown in FIG. 1). In some embodiments, head length 121 may be from about 10 mm to about 30 mm. In some embodiments, head length 121 may be about 18 mm.

Shell 112 further includes a skirt 122. Skirt 122 is detachably connected to head 120 along a bridge line 126. In the illustrated embodiment of FIG. 2A, screwcap 110 further includes a plurality of bridges 128 disposed along bridge line 126 and detachably connecting head 120 to skirt 122. Further, in the illustrated embodiment of FIG. 2A, plurality of bridges 128 defines a plurality of perforations 134 therebetween. Thus, in some cases, bridge line 126 may provide a line of weakness about which head 120 may be detachable from skirt 122. Head 120 may be detached from skirt 122 about bridge line 126 to access a product stored in the bottle 100 (shown in FIG. 1). Bridge line 126 may also act as a tamper-proof feature.

In some embodiments, a width of each bridge 128 substantially normal to longitudinal axis 10 may be from about 1.25 mm to about 1.35 mm. In some embodiments, a number of plurality of bridges 128 may be from about 5 to about 15. In some embodiments, the number of plurality of bridges 128 may be 8, and plurality of bridges 128 may define 8 perforations 134 therebetween.

Skirt 122 further includes a first support ring 140, a second support ring 160, and a third support ring 180.

As shown in FIG. 2A, first support ring 140 is disposed proximal to bridge line 126. Further, second support ring 160 is disposed distal to bridge line 126. Moreover, third support ring 180 is disposed between first support ring 140 and second support ring 160 relative to longitudinal axis 10.

In some embodiments, at least a portion of third support ring 180 is configured to deform and engage shoulder 104 (shown in FIG. 1) of neck 102 (shown in FIG. 1) after crimping. In other words, in some embodiments, shell 112 may be crimped, such that at least a portion of third support ring 180 may deform and engage shoulder 104. Therefore, it may be noted that a position of first, second, and third support rings 140, 160, 180 may depend upon a profile of neck 102.

In some embodiments, first support ring 140 may be configured to protect bridge line 126 during crimping of shell 112. In some embodiments, second support ring 160 may be configured to improve an appearance of screwcap 110 after crimping of shell 112. In some embodiments, third support ring 180 may be configured to reduce or eliminate distortion of the first and second support rings 140, 160 during crimping of shell 112.

As shown in FIG. 2A, skirt 122 has a nominal outer diameter 124. Nominal outer diameter 124 of skirt 122 may be defined as a minimum outer diameter of skirt 122. Specifically, nominal outer diameter 124 of skirt 122 may be defined as a minimum outer diameter of skirt 122 before crimping. In some embodiments, nominal outer diameter 124 is defined between third support ring 180 and second support ring 160 relative to longitudinal axis 10. Nominal outer diameter 124 of skirt 122 may depend upon the design and dimensions of bottle 100 (shown in FIG. 1). In some embodiments, nominal outer diameter 124 of skirt 122 may be from about 25 mm to about 35 mm. In some embodiments, nominal outer diameter 124 of skirt 122 may be from about 29.5 mm to about 30 mm.

Figure 2B:
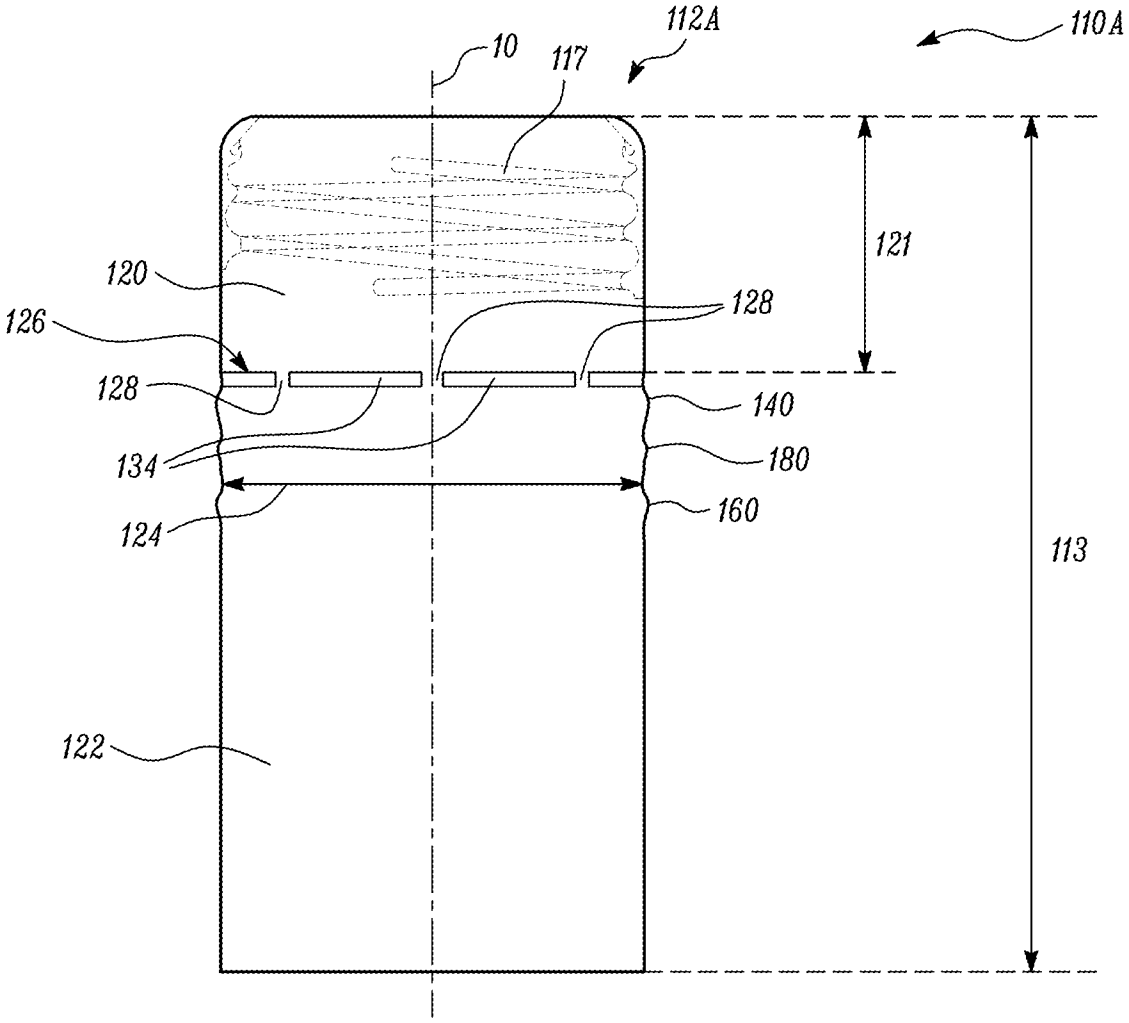
FIG. 2B illustrates a schematic front view of a screwcap in accordance with another embodiment of the present disclosure.

FIG. 2B shows a schematic front view of a screwcap 110A in accordance with another embodiment of the present disclosure. Screwcap 110A is substantially similar to screwcap 110 of FIG. 2A, with like elements designated by like numbers. However, screwcap 110A includes a shell 112A having a different configuration as compared to shell 112 of screwcap 110.

Referring to FIGS. 1 and 2B, in some embodiments, head 120 includes at least one internal thread 117 (shown by dashed lines) configured to engage with at least one external thread 108 of neck 102. Therefore, insert 114 may be omitted from screwcap 110A.

Figure 3:
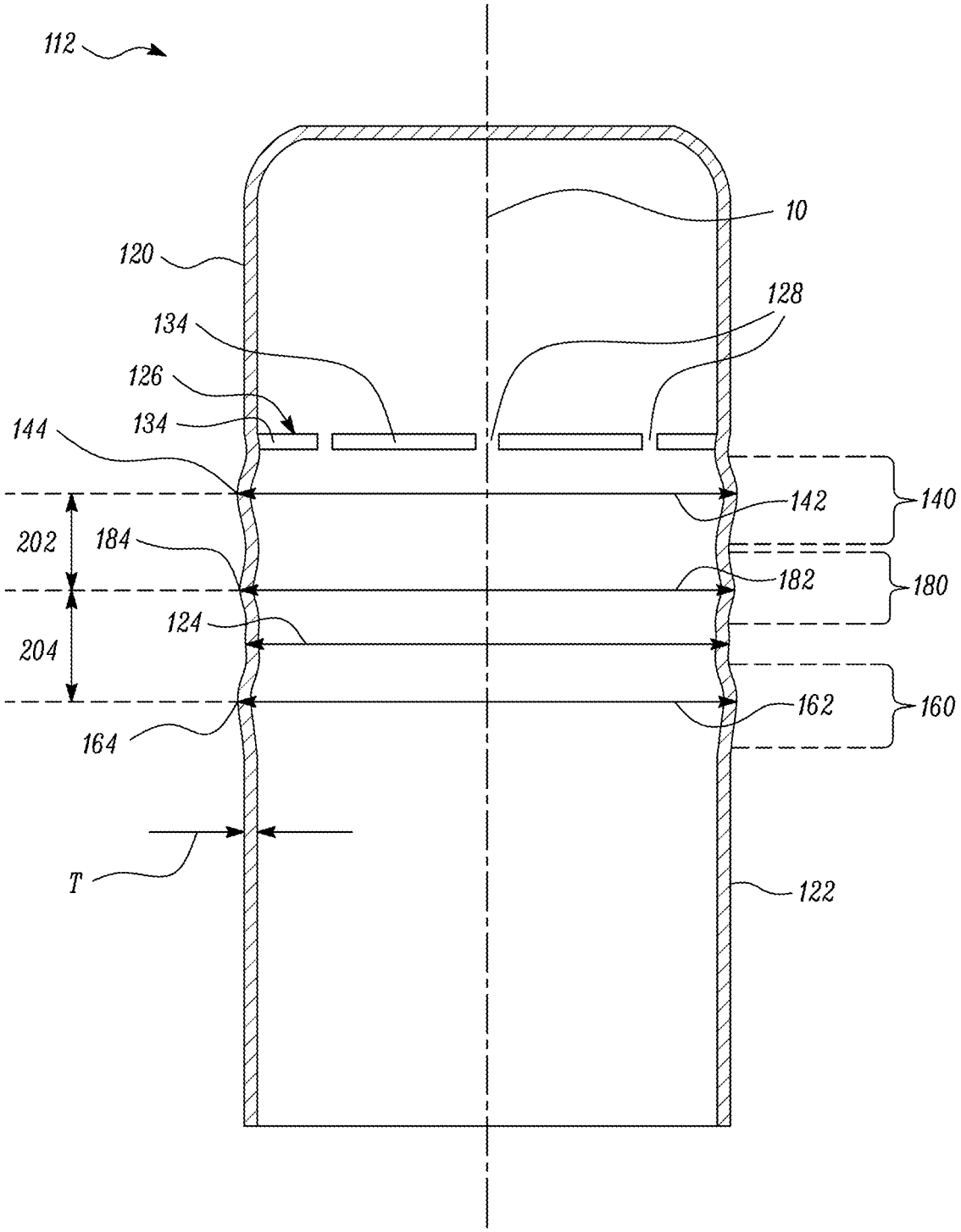
FIG. 3 illustrates a schematic cross-sectional view of a shell in accordance with an embodiment of the present disclosure.

FIG. 3 shows a schematic cross-sectional view of shell 112 in accordance with an embodiment of the present disclosure.

Shell 112 has an average thickness T. Average thickness T of shell 112 may depend upon desired application attributes and a material of shell 112. In some embodiments, shell 112 may have average thickness T of about 0.20 mm to about 0.30 mm. In some embodiments, shell 112 has average thickness T of about 0.25 mm.

First support ring 140 has a first maximum outer diameter 142 greater than nominal outer diameter 124 of skirt 122. In the illustrated embodiment of FIG. 3, first support ring 140 includes a first peak 144 having first maximum outer diameter 142. In other words, in the illustrated embodiment of FIG. 3, first maximum outer diameter 142 is a maximum outer diameter of first support ring 140 at first peak 144.

Second support ring 160 has a second maximum outer diameter 162 greater than nominal outer diameter 124 of skirt 122. In the illustrated embodiment of FIG. 3, second support ring 160 includes a second peak 164 having second maximum outer diameter 162. In other words, in the illustrated embodiment of FIG. 3, second maximum outer diameter 162 is a maximum outer diameter of second support ring 160 at second peak 164.

As shown in FIG. 3, in some embodiments, each of first and second support rings 140, 160 has a curved cross-sectional shape. However, first and second support rings 140, 160 may have any suitable cross-sectional shape depending on desired aesthetics and application attributes. In some embodiments, each of first and second support rings 140, 160 may have an asymmetric shape. The asymmetric shape may increase rigidity of first and second support rings 140, 160 during crimping of shell 112. In some cases, second support ring 160 may be positioned lower to further reduce distortion of second support ring 160 during crimping of shell 112. This may further reduce defects such as facets on screwcap 110.

Third support ring 180 has a third maximum outer diameter 182 greater than nominal outer diameter 124 of skirt 122. In the illustrated embodiment of FIG. 3, third support ring 180 includes a third peak 184 having third maximum outer diameter 182. In other words, in the illustrated embodiment of FIG. 3, third maximum outer diameter 182 is a maximum outer diameter of third support ring 180 at third peak 184. In some embodiments, third maximum outer diameter 182 is greater than nominal outer diameter 124 by at least 0.5 mm. In some embodiments, third maximum outer diameter 182 may be greater than nominal outer diameter 124 by at least 0.2 mm, at least 0.3 mm, at least 0.4 mm, at least 0.6 mm, at least 0.7 mm, or at least 0.8 mm.

In some embodiments, third support ring 180 has a symmetric shape along longitudinal axis 10. However, in some other embodiments, third support ring 180 may have an asymmetric shape along longitudinal axis 10. In the illustrated embodiment of FIG. 3, third support ring 180 has a V-shaped cross-section along longitudinal axis 10.

In some embodiments, first maximum outer diameter 142, second maximum outer diameter 162, and third maximum outer diameter 182 are substantially equal to one another. However, in some other embodiments, first maximum outer diameter 142, second maximum outer diameter 162, and third maximum outer diameter 182 may be different from one another. For example, in some embodiments, third maximum outer diameter 182 of third support ring 180 may be greater than both first maximum outer diameter 142 of first support ring 140 and second maximum outer diameter 162 of second support ring 160.

In some embodiments, first peak 144 and third peak 184 define a first distance 202 therebetween. Further, in some embodiments, second peak 164 and third peak 184 define a second distance 204 therebetween. In some embodiments, first distance 202 between first peak 144 and third peak 184 is less than second distance 204 between second peak 164 and third peak 184. In some embodiments, second distance 204 is greater than first distance 202 by a factor of at least 1.3. In other words, in some embodiments, second distance 204 is greater than or equal to 1.3 times of first distance 202. In some embodiments, first distance 202 is about 3 mm, and second distance 204 is about 4 mm. Therefore, second support ring 160 is positioned relatively lower in skirt 122 along longitudinal axis 10.

Figure 4:
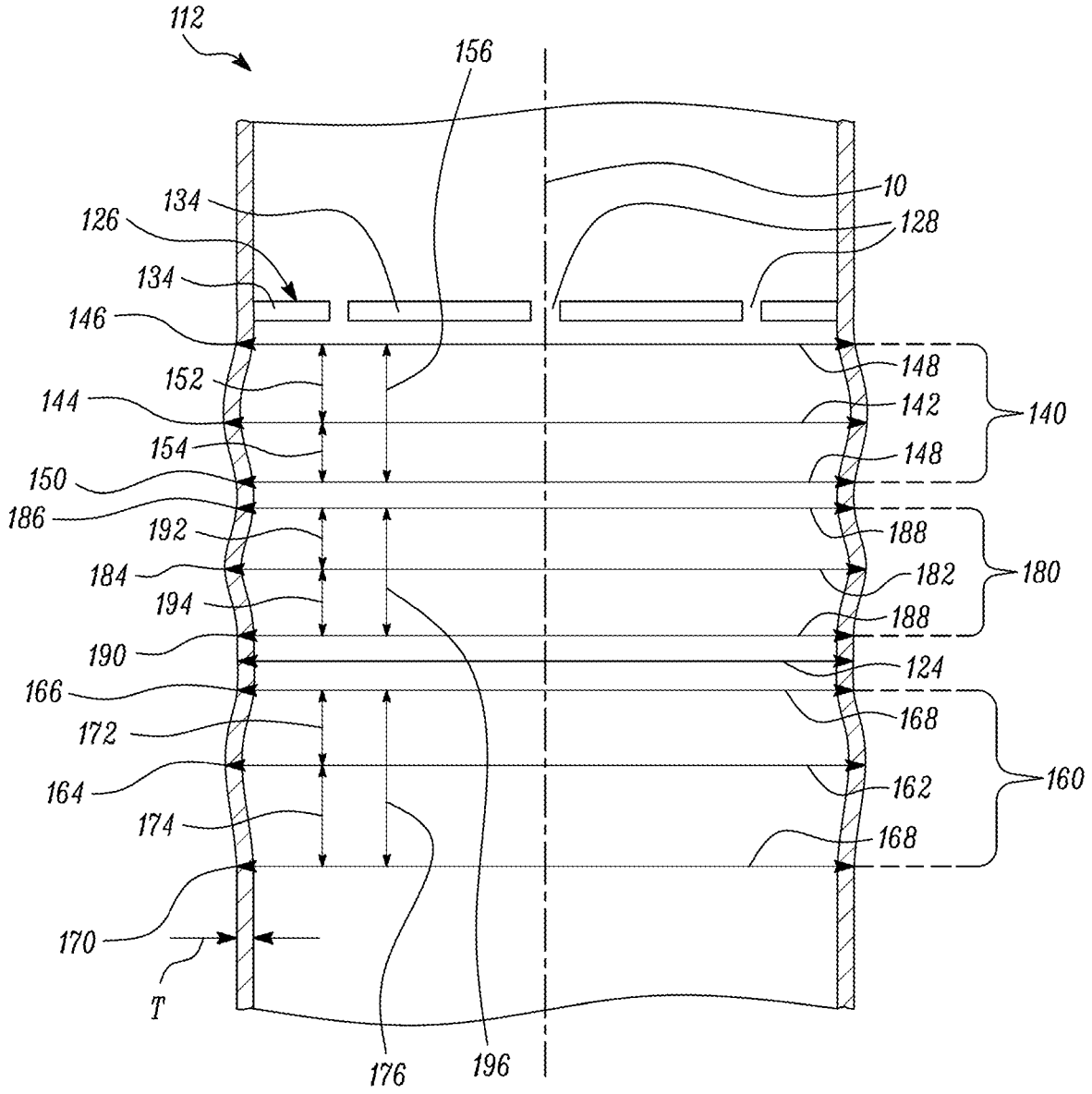
FIG. 4 illustrates an enlarged cross-sectional view of a portion of the shell of FIG. 3.

FIG. 4 shows an enlarged cross-sectional view of skirt 122 in accordance with an embodiment of the present disclosure.

In the illustrated embodiment of FIG. 4, first support ring 140 further includes a first proximal end 146 proximal to bridge line 126. In the illustrated embodiment of FIG. 4, first support ring 140 further includes a first distal end 150 distal to bridge line 126. In some embodiments, first peak 144 is disposed between first proximal end 146 and first distal end 150 along longitudinal axis 10.

In the illustrated embodiment of FIG. 4, first proximal end 146 has a first minimum outer diameter 148 of the first support ring 140. Further, in the illustrated embodiment of FIG. 4, first distal end 150 has first minimum outer diameter 148 of first support ring 140. In other words, in the illustrated embodiment of FIG. 4, first proximal end 146 and first distal end 150 have a substantially equal outer diameter, that is, first minimum outer diameter 148.

In some embodiments, first proximal end 146 and first peak 144 define a first proximal peak distance 152 therebetween along longitudinal axis 10. In some embodiments, first distal end 150 and first peak 144 define a first distal peak distance 154 therebetween along longitudinal axis 10.

In some embodiments, first proximal peak distance 152 between first proximal end 146 and first peak 144 along longitudinal axis 10 is greater than first distal peak distance 154 between first distal end 150 and first peak 144 along longitudinal axis 10. In some cases, first proximal peak distance 152 being greater than first distal peak distance 154 may improve rigidity of first support ring 140 during crimping of shell 112.

In some embodiments, first proximal peak distance 152 is greater than first distal peak distance 154 by a factor of at least about 1.3. In other words, in some embodiments, first proximal peak distance 152 is greater than or equal to 1.3 times of first distal peak distance 154. In some embodiments, first proximal peak distance 152 may be about 1.6 mm, and first distal peak distance 154 may be about 1.2 mm.

Further, in the illustrated embodiment of FIG. 4, first support ring 140 has a first length 156 along longitudinal axis 10. In some embodiments, first length 156 may be defined as a sum of first proximal peak distance 152 and first distal peak distance 154. In some embodiments, first length 156 is about 2.8 mm. However, in some other embodiments, first length 156 may be about 2.5 mm, about 2.6 mm, about 2.7 mm, about 2.9 mm, or about 3 mm.

In the illustrated embodiment of FIG. 4, second support ring 160 further includes a second proximal end 166 proximal to bridge line 126. In the illustrated embodiment of FIG. 4, second support ring 160 further includes a second distal end 170 distal to bridge line 126. In some embodiments, second peak 164 is disposed between second proximal end 166 and second distal end 170 along longitudinal axis 10.

In the illustrated embodiment of FIG. 4, second proximal end 166 has a second minimum outer diameter 168 of second support ring 160. In the illustrated embodiment of FIG. 4, second distal end 170 has second minimum outer diameter 168 of second support ring 160. In other words, in the illustrated embodiment of FIG. 4, second proximal end 166 and second distal end 170 have a substantially equal outer diameter, that is, second minimum outer diameter 168.

In some embodiments, second proximal end 166 and second peak 164 define a second proximal peak distance 172 therebetween along longitudinal axis 10. Further, in some embodiments, second distal end 170 and second peak 164 define a second distal peak distance 174 therebetween along longitudinal axis 10.

In some embodiments, second proximal peak distance 172 between second proximal end 166 and second peak 164 along longitudinal axis 10 is less than second distal peak distance 174 between second distal end 170 and second peak 164 along longitudinal axis 10. In some cases, second proximal peak distance 172 being less than second distal peak distance 174 may improve rigidity of second support ring 160 during crimping of shell 112.

In some embodiments, second distal peak distance 174 is greater than second proximal peak distance 172 by a factor of at least about 1.9. In other words, in some embodiments, second distal peak distance 174 is greater than or equal to about 1.9 times of second proximal peak distance 172. In some embodiments, second proximal peak distance 172 may be about 1.2 mm, and first distal peak distance 154 may be about 2.3 mm.

In the illustrated embodiment of FIG. 4, second support ring 160 has a second length 176 along longitudinal axis 10. In some embodiments, second length 176 may be defined as a sum of second proximal peak distance 172 and second distal peak distance 174. In some embodiments, second length 176 is about 3.5 mm. However, in some other embodiments, second length 176 may be about 3.3 mm, about 3.4 mm, about 3.6 mm, about 3.7 mm, or about 3.8 mm.

In the illustrated embodiment of FIG. 4, third support ring 180 further includes a third proximal end 186 proximal to bridge line 126. In the illustrated embodiment of FIG. 4, third support ring 180 further includes a third distal end 190 distal to bridge line 126. In some embodiments, third peak 184 is disposed between third proximal end 186 and third distal end 190 along longitudinal axis 10.

In the illustrated embodiment of FIG. 4, third proximal end 186 has a third minimum outer diameter 188 of third support ring 180. Further, in the illustrated embodiment of FIG. 4, third distal end 190 has third minimum outer diameter 188 of third support ring 180. In other words, in the illustrated embodiment of FIG. 4, third proximal end 186 and third distal end 190 have a substantially equal outer diameter, that is, third minimum outer diameter 188.

In some embodiments, third proximal end 186 and third peak 184 define a third proximal peak distance 192 therebetween along longitudinal axis 10. Further, in some embodiments, third distal end 190 and third peak 184 define a third distal peak distance 194 therebetween along longitudinal axis 10.

In some embodiments, third proximal peak distance 192 between third proximal end 186 and third peak 184 along longitudinal axis 10 is substantially equal to third distal peak distance 194 between third distal end 190 and third peak 184 along longitudinal axis 10. Specifically, in some embodiments, third support ring 180 may be symmetric about third peak 184 along longitudinal axis 10. In some embodiments, third proximal peak distance 192 may be about 1.2 mm and third distal peak distance 194 may be about 1.2 mm.

However, in some other embodiments, third proximal peak distance 192 between third proximal end 186 and third peak 184 along longitudinal axis 10 may be different from third distal peak distance 194 between third distal end 190 and third peak 184 along longitudinal axis 10. In other words, in some embodiments, third support ring 180 may be asymmetric about third peak 184 along longitudinal axis 10.

Further, in the illustrated embodiment of FIG. 4, third support ring 180 has a third length 196 along longitudinal axis 10. In some embodiments, third length 196 may be defined as a sum of third proximal peak distance 192 and third distal peak distance 194. In some embodiments, third length 196 is about 2.4 mm. However, in some other embodiments, third length 196 may be about 2.2 mm, about 2.3 mm, about 2.5 mm, about 2.6 mm, or about 2.7 mm.

In some embodiments, third length 196 is less than each of first length 156 and second length 176. That is, in some embodiments, third support ring 180 may be smaller than each of first support ring 140 and second support ring 160 along longitudinal axis 10.

In some embodiments, first length 156 is greater than third length 196 by a factor of at least 1.16. In other words, in some embodiments, first length 156 is greater than or equal to about 1.16 times of third length 196.

Further, in some embodiments, second length 176 is greater than third length 196 by a factor of at least 1.45. In other words, in some embodiments, second length 176 is greater than or equal to about 1.45 times of third length 196.

Figure 5A:
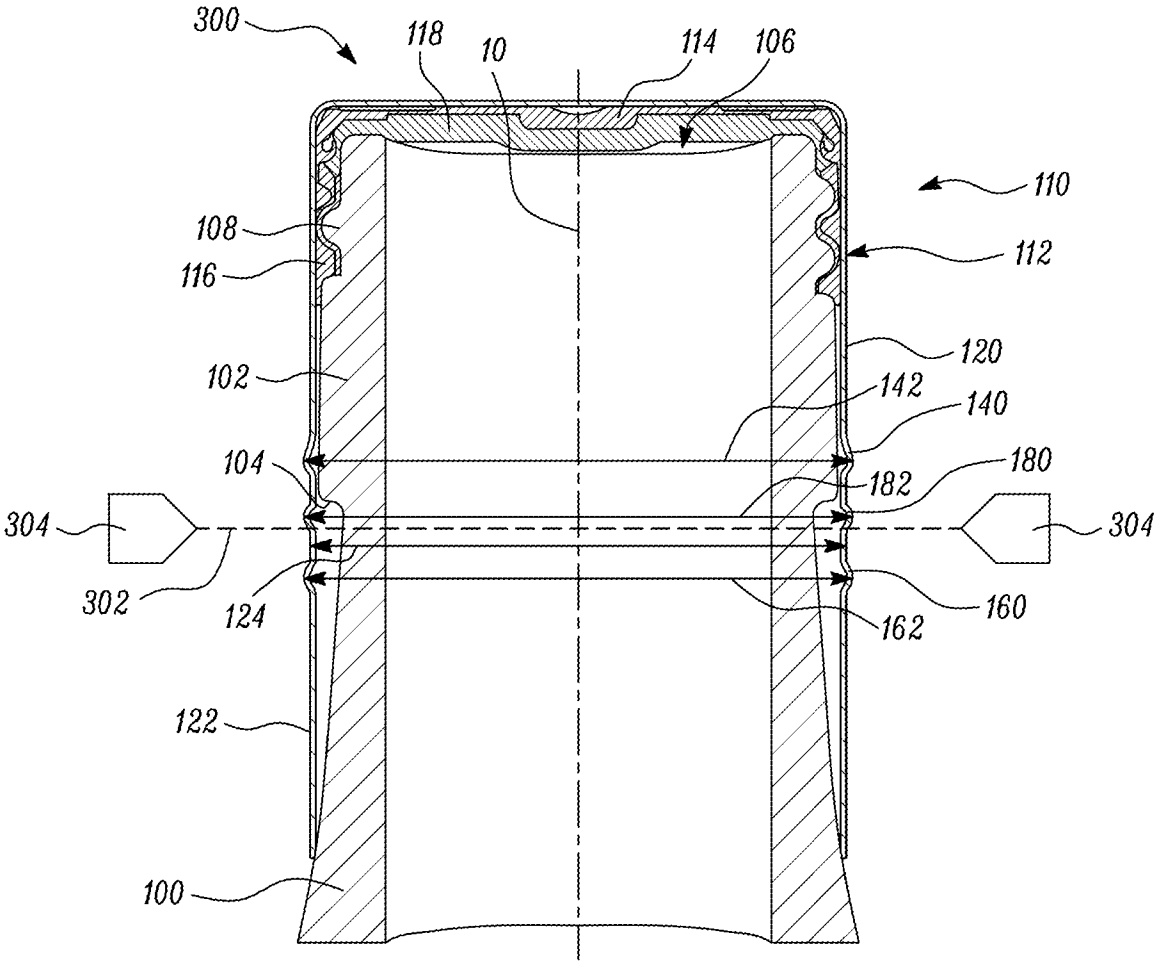
FIG. 5A illustrates a schematic cross-sectional view of a bottle assembly before crimping in accordance with an embodiment of the present disclosure.
Figure 5C:
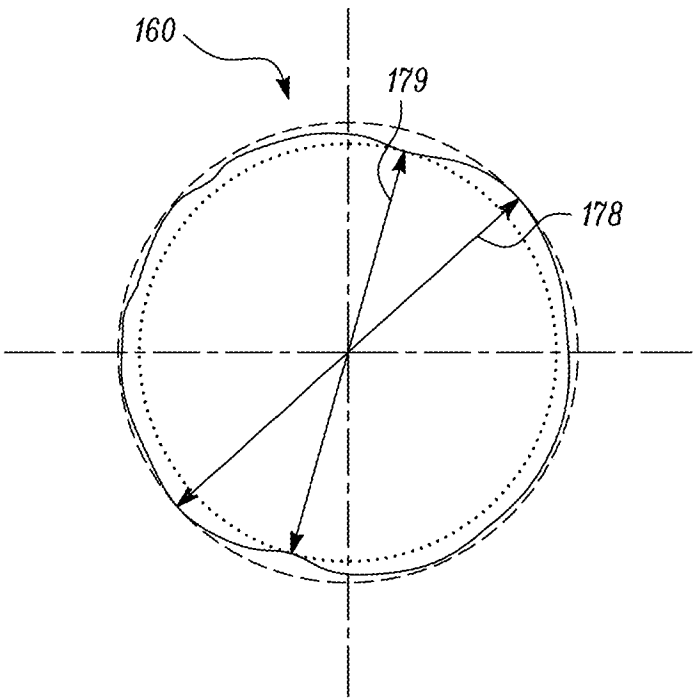
FIG. 5C illustrates a schematic plan view of a second support ring after crimping in accordance with an embodiment of the present disclosure.
Figure 5B:
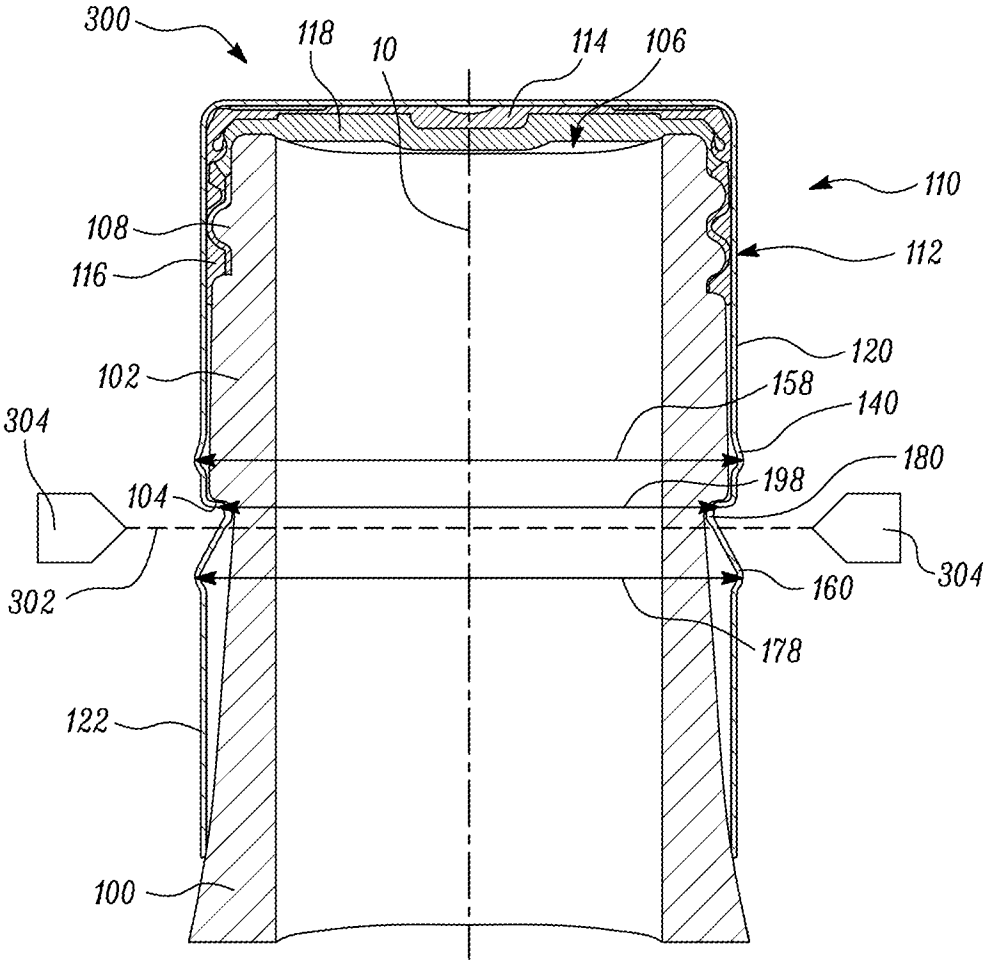
FIG. 5B illustrates a schematic cross-sectional view of the bottle assembly after crimping in accordance with an embodiment of the present disclosure.

FIGS. 5A and 5B show schematic cross-sectional views of bottle assembly 300 in accordance with an embodiment of the present disclosure. Specifically, FIG. 5A shows a schematic cross-sectional view of bottle assembly 300 before crimping of shell 112, and FIG. 5B shows a schematic cross-sectional view of bottle assembly 300 after crimping of shell 112.

As discussed above, bottle assembly 300 includes bottle 100 and screwcap 110.

Referring to FIGS. 5A and 5B, in some embodiments, crimping rollers 304 may be used to crimp shell 112 to neck 102 of bottle 100. In some cases, shell 112 may be crimped to neck 102 by crimping rollers 304 at an optimal position 302. Optimal position 302 may reduce defects and improve sealing of opening 106 of bottle 100 by screwcap 110. In some embodiments, optimal position 302 may be about 0.3 mm below neck 102 of bottle 100. Specifically, in some embodiments, optimal position 302 may be about 0.3 mm below shoulder 104 of neck 102.

In some embodiments, shell 112 is crimped to neck 102, such that at least a portion of third support ring 180 deforms and engages shoulder 104 of neck 102 after crimping. Third support ring 180 has a third maximum crimped outer diameter 198 after crimping. Third maximum crimped outer diameter 198 is less than nominal outer diameter 124 of skirt 122.

Advantageously, third support ring 180 may allow crimping of shell 112 at a greater penetration by crimping rollers 304 on neck 102 to reduce third maximum crimped outer diameter 198. Reduction of third maximum crimped outer diameter 198 may prevent the undesired pull-off of screwcap 110 from bottle 100.

Further, third support ring 180 may allow second support ring 160 of skirt 122 to be positioned lower as compared to a conventional screwcap. This may further reduce distortion of second support ring 160 during crimping, thereby preventing several defects such as bird beaks and facets.

Further, in the illustrated embodiment of FIG. 5B, first support ring 140 has a first maximum crimped outer diameter 158 after crimping. In some embodiments, first maximum crimped outer diameter 158 is substantially equal to first maximum outer diameter 142. In other words, in some embodiments, first maximum outer diameter 142 of first support ring 140 may remain substantially unchanged after crimping.

FIG. 5C shows a plan view of second support ring 160 depicting a circularity of second support ring 160 after crimping. Referring to FIGS. 5A to 5C, second support ring 160 has a second maximum crimped outer diameter 178 (shown by a dashed circle in FIG. 5C) after crimping and a second minimum crimped outer diameter 179 (shown by a dotted circle in FIG. 5C) after crimping. In some embodiments, second maximum crimped outer diameter 178 may be substantially equal to second maximum outer diameter 162. In other words, in some embodiments, second maximum outer diameter 162 may remain substantially unchanged after crimping.

In some embodiments, a difference between second maximum crimped outer diameter 178 and second minimum crimped outer diameter 179 is less than about 0.25 mm. That is, in some embodiments, second maximum crimped outer diameter 178—second minimum crimped outer diameter 179<0.25 mm. In some embodiments, the difference between second maximum crimped outer diameter 178 and second minimum crimped outer diameter 179 may be in a range between about 0 mm and about 0.25 mm.

Thus, third support ring 180 may improve the circularity of second support ring 160. This may further improve an appearance of screwcap 110 on bottle 100.

Figure 6:
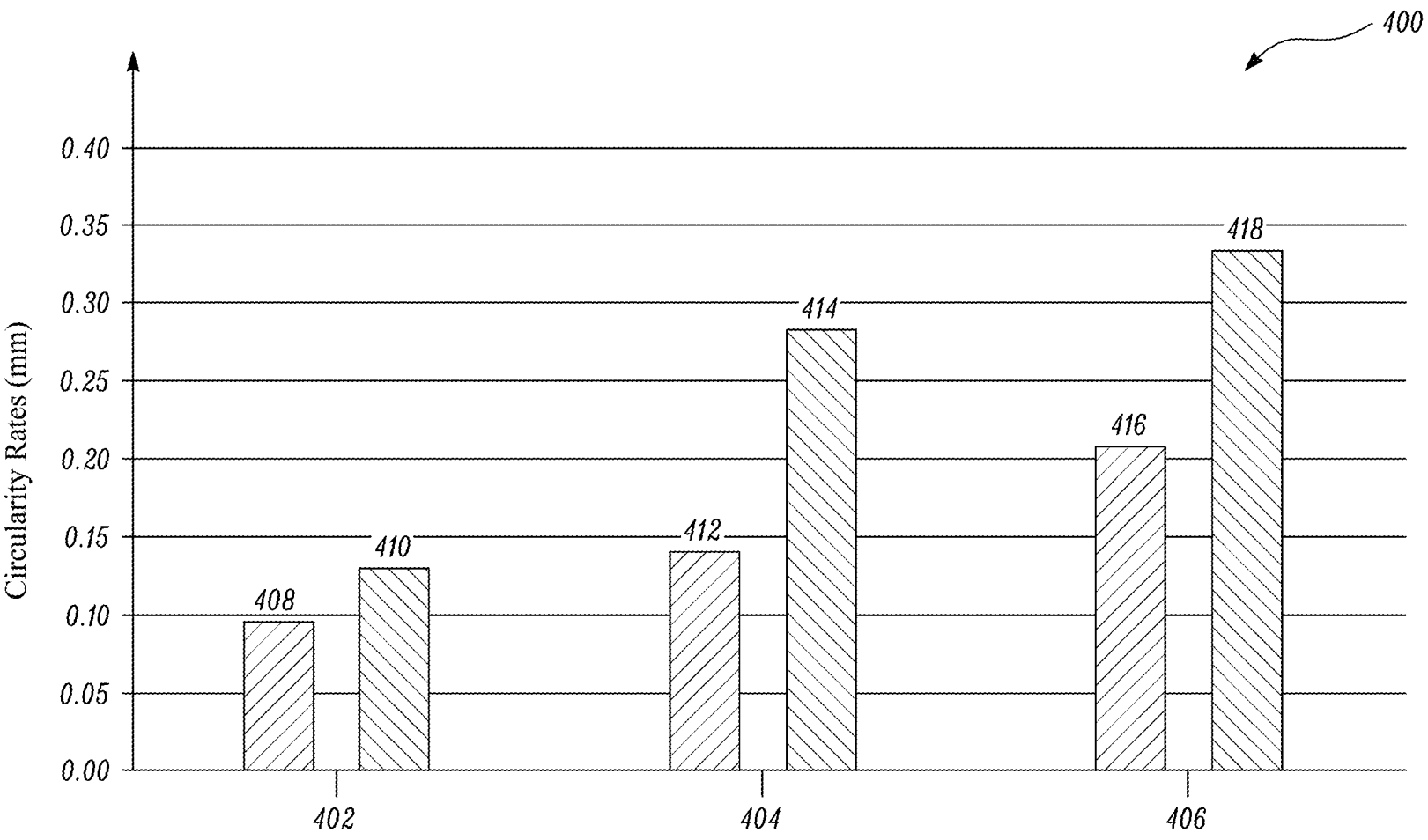
FIG. 6 illustrates a graph comparing a circularity rate of a second support ring of the present disclosure and a second support ring of conventional screwcaps after crimping with respect to different positions of crimping rollers.

FIG. 6 shows a graph 400. Referring to FIGS. 5A to 6, graph 400 represents a circularity rate with respect to different positions of crimping rollers 304. The circularity rate may be defined as a difference between a maximum crimped outer diameter and a minimum crimped outer diameter.

Specifically, graph 400 represents the circularity rate of second support ring 160 with respect to the different positions of crimping rollers 304 during crimping of shell 112. The circularity rate of second support ring 160 may be defined as a difference between second maximum crimped outer diameter 178 and second minimum crimped outer diameter 179. Graph 400 further represents the circularity rate of a second support ring of a conventional screwcap with respect to the different positions of crimping rollers 304 during crimping of the conventional screwcap.

Graph 400 depicts the circularity rate (in mm) on the ordinate (Y-axis), and the different positions of the crimping rollers 304 during crimping on the abscissa (X-axis). The different positions of the crimping rollers 304 during crimping include a first position 402, a second position 404, and a third position 406. First position 402 is optimal position 302 of the crimping rollers 304 during crimping. Second position 404 is about 0.5 mm below optimal position 302. Third position 406 is about 1 mm below optimal position 302.

Graph 400 includes a first bar 408 and a second bar 410 representing the circularity rates of second support ring 160 of screwcap 110 and the second support ring of the conventional screwcap, respectively, at first position 402. As depicted by first and second bars 408, 410, second support ring 160 has a smaller circularity rate (about 0.09 mm vs. about 0.13 mm) than the conventional screwcap at first position 402. Consequently, second support ring 160 has a greater circularity than the second support ring of the conventional screwcap at first position 402. Thus, when crimped at first position 402, screwcap 110 of the present disclosure may have a better appearance than the conventional screwcap.

Graph 400 further includes a third bar 412 and a fourth bar 414 representing the circularity rates of second support rings of screwcap 110 and the second support ring of the conventional screwcap, respectively, at second position 404. As depicted by third and fourth bars 412, 414, second support ring 160 has a substantially smaller circularity rate (about 0.14 mm vs. about 0.28 mm) than the conventional screwcap at second position 404. Consequently, second support ring 160 has a substantially greater circularity than the second support ring of the conventional screwcap at second position 404. Thus, when crimped at second position 404, screwcap 110 of the present disclosure may have a substantially better appearance than the conventional screwcap. Further, screwcap 110 may prevent bird beaks when crimped at second position 404, while the conventional screwcap may experience bird beaks when crimped at second position 404.

Graph 400 further includes a fifth bar 416 and a sixth bar 418 representing the circularity rates of second support rings of screwcap 110 and the conventional screwcap, respectively, at third position 406. As depicted by fifth and sixth bars 416, 418, second support ring 160 has a substantially smaller circularity rate (about 0.20 mm vs. about 0.33 mm) than the conventional screwcap at third position 406. Consequently, second support ring 160 has a substantially greater circularity than the second support ring of the conventional screwcap at third position 406. Thus, when crimped at third position 406, screwcap 110 of the present disclosure may have a substantially better appearance than the conventional screwcap. Further, screwcap 110 may prevent facets when crimped at third position 406, as compared to the conventional screwcap that may experience facets when crimped at third position 406.

As depicted by graph 400, the circularity rates of second support ring 160 of screwcap 110 are lower than the circularity rates of the second support ring of the conventional screwcap. The circularity rates of second support ring 160 of screwcap 110 at the different positions are less than 0.25 mm. Therefore, second support ring 160 of screwcap 110 may not experience defects, such as bird beaks and facets, during crimping, and improve the appearance of the bottle 100.

Comparative Examples

The screwcap of the present disclosure (hereinafter referred to as "the new screwcap") was crimped to a neck of a bottle at different positions and under different lateral loads (about 8.5 kilograms (kg) and about 9.5 kg) by crimping rollers. Similarly, a conventional screwcap was crimped to the neck of the bottle at the different positions and under the different lateral loads by the crimping rollers.

The crimping of the new screwcap and the conventional screwcap was repeated 10 times for each of the different positions and lateral loads. Defects were observed for the different lateral loads applied at the different positions by the crimping rollers on the new screwcap and the conventional screwcap.

Case 1:

The new screwcap and the conventional screwcap were crimped to the neck of the bottle at an optimal position under the different lateral loads by the crimping rollers. The optimal position was about 0.3 mm below the neck of the bottle.

Percentage occurrence of defects in the new screwcap and the conventional screwcap due to crimping at the optimal position under the different lateral loads was determined and is tabulated in Table 1 below.

TABLE 1

| Details of Defect Occurrence in Percentage | | | | |
|---|---|---|---|---|
| Screwcap Type | Lateral Load | Bird Beaks | Facets | Pull-off |
| New Screwcap | 8.5 Kg | 0% | 0% | 0% |
| Conventional Screwcap | | 0% | 0% | 100% |
| New Screwcap | 9.5 Kg | 0% | 0% | 0% |
| Conventional Screwcap | | 0% | 0% | 30% |

Referring to Table 1, it was determined that when crimped at the optimal position and under 8.5 kg lateral load, the conventional screwcap experienced a pull-off defect (i.e., undesirable removal of a screwcap from the bottle upon application of a force) 100% of the times. Further, at the optimal position and under 9.5 kg lateral load, the conventional screwcap experienced the pull-off defect 30% of the times. On the other hand, the new screwcap did not experience the pull-off defect when crimped at the optimal position and under both 8.5 kg and 9.5 kg lateral loads. It was observed that the new screwcap clenched better to the bottle after crimping.

Case 2:

The new screwcap and the conventional screwcap were crimped to the neck of the bottle at a second position about 0.25 mm below the optimal position under the different lateral loads by the crimping rollers.

Percentage occurrence of defects in the new screwcap and the conventional screwcap due to crimping at the second position under the different lateral loads was determined and is tabulated in Table 2 below.

TABLE 2

| Details of Defect Occurrence in Percentage | | | | |
|---|---|---|---|---|
| Screwcap Type | Lateral Load | Bird Beaks | Facets | Pull-off |
| New Screwcap | 8.5 Kg | 0% | 0% | 0% |
| Conventional Screwcap | | 100% | 0% | 100% |
| New Screwcap | 9.5 Kg | 0% | 0% | 0% |
| Conventional Screwcap | | 100% | 0% | 30% |

Referring to Table 2, it was determined that when crimped at the second position and under 8.5 kg lateral load, the conventional screwcap experienced the pull-off defect as well as bird beaks 100% of the times. Further, when crimped at the second position and under 9.5 kg lateral load, the conventional screwcap experienced the bird beaks 100% of the time, and the pull-off defect 30% of the times.

However, the new screwcap did not experience the pull-off defect and the bird beaks at the second position and under both 8.5 kg and 9.5 kg lateral loads. The new screwcap prevented both the pull-off defect and the bird beaks when crimped at the second position under the different lateral loads.

Case 3:

The new screwcap and the conventional screwcap were crimped to the neck of the bottle at a third position about 0.375 mm below the optimal position under the different lateral loads by the crimping rollers.

Percentage occurrence of defects in the new screwcap and the conventional screwcap due to crimping at the third position under the different lateral loads was determined and is tabulated in Table 3 below.

TABLE 3

| Details of Defect Occurrence in Percentage | | | | |
|---|---|---|---|---|
| Screwcap Type | Lateral Load | Bird Beaks | Facets | Pull-off |
| New Screwcap | 8.5 Kg | 0% | 0% | 0% |
| Conventional Screwcap | | 100% | 100% | 100% |
| New Screwcap | 9.5 Kg | 0% | 0% | 0% |
| Conventional Screwcap | | 100% | 100% | 0% |

Referring to Table 3, it was determined that when crimped at the third position and under 8.5 kg lateral load, the conventional screwcap experienced the pull-off defect, facets, as well as bird beaks 100% of the times. Further, when crimped at the third position and under 9.5 kg lateral load, the conventional screwcap experienced the bird beaks and the facets 100% of the times.

However, the new screwcap did not experience the pull-off defect, the facets, and the bird beaks at the third position and under both 8.5 kg and 9.5 kg lateral loads. The new screwcap prevented all three of the defects at the third position under the different lateral loads.

Thus, it was concluded that the new screwcap overcame the defects, such as the bird beaks, facets, and pull-off, regardless of the different lateral loads and the different positions of the crimping rollers.

Each and every document cited in this present application, including any cross referenced, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

Unless otherwise indicated, all numbers expressing sizes, amounts, ranges, limits, and physical and other properties used in the present application are to be understood as being preceded in all instances ay the term "about". Accordingly, unless expressly indicated to the contrary, the numerical parameters set forth in the present application are approximations that can vary depending on the desired properties sought to be obtained by a person of ordinary skill in the art without undue experimentation using the teachings disclosed in the present application.

As used in the present application, the singular forms "a", "an", and "the" encompass embodiments having plural referents, unless the context clearly dictates otherwise. As used in the present application, the term "or" is generally employed in its sense including "and/or", "unless" the context clearly dictates otherwise.

Spatially related terms, including but not limited to, "lower", "upper", "beneath", "below", "above", "bottom" and "top", if used in the present application, are used for ease of description to describe spatial relationships of an element(s) to another. Such spatially related terms encompass different orientations of the device in use or operation, in addition to the particular orientations depicted in the figures and described in the present application. For example, if an object depicted in the drawings is turned over or flipped over, elements previously described as below, or beneath other elements would then be above those other elements.

The drawings show some but not all embodiments. The elements depicted in the drawings are illustrative and not necessarily to scale, and the same or similar) reference numbers denote the same (or similar) features throughout the drawings.

The description, examples, embodiments, and drawings disclosed are illustrative only and should not be interpreted as limiting. The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Modifications and other embodiments will be apparent to a person of ordinary skill in the packaging arts, and all such modifications and other embodiments are intended and deemed to be within the scope of the present invention.

The invention claimed is:

1. A screwcap for sealing a neck of a bottle, the screwcap comprising:

a shell extending along a longitudinal axis and configured to be disposed on the neck, the shell comprising:

a head; and a skirt having a nominal outer diameter and detachably connected to the head along a bridge line, the skirt comprising:

a first support ring disposed proximal to the bridge line, the first support ring having a first maximum outer diameter greater than the nominal outer diameter of the skirt;

a second support ring disposed distal to the bridge line, the second support ring having a second maximum outer diameter greater than the nominal outer diameter of the skirt; and a third support ring disposed between the first support ring and the second support ring relative to the longitudinal axis, the third support ring having a third maximum outer diameter greater than the nominal outer diameter of the skirt, and wherein at least a portion of the third support ring is configured to deform and engage a shoulder of the neck after crimping.

2. The screwcap of claim 1, wherein:

the first support ring comprises a first peak having the first maximum outer diameter;

the second support ring comprises a second peak having the second maximum outer diameter;

the third support ring comprises a third peak having the third maximum outer diameter; and a first distance between the first peak and the third peak is less than a second distance between the second peak and the third peak.

3. The screwcap of claim 2, wherein the second distance is greater than the first distance by a factor of at least 1.3.

4. The screwcap of claim 2, wherein the first distance is 3 millimeters (mm), and the second distance is 4 mm.

5. The screwcap of claim 1, wherein the first support ring further comprises:

a first proximal end proximal to the bridge line and having a first minimum outer diameter of the first support ring; and a first distal end distal to the bridge line and having the first minimum outer diameter of the first support ring;

wherein the first peak is disposed between the first proximal end and the first distal end along the longitudinal axis; and wherein a first proximal peak distance between the first proximal end and the first peak along the longitudinal axis is greater than a first distal peak distance between the first distal end and the first peak along the longitudinal axis.

6. The screwcap of claim 1, wherein the second support ring further comprises:

a second proximal end proximal to the bridge line and having a second minimum outer diameter of the second support ring; and a second distal end distal to the bridge line and having the second minimum outer diameter of the second support ring;

wherein the second peak is disposed between the second proximal end and the second distal end along the longitudinal axis; and wherein a second proximal peak distance between the second proximal end and the second peak along the longitudinal axis is less than a second distal peak distance between the second distal end and the second peak along the longitudinal axis.

7. The screwcap of claim 1, wherein the third support ring further comprises:

a third proximal end proximal to the bridge line and having a third minimum outer diameter of the third support ring; and a third distal end distal to the bridge line and having the third minimum outer diameter of the third support ring;

wherein the third peak is disposed between the third proximal end and the third distal end along the longitudinal axis; and wherein a third proximal peak distance between the third proximal end and the third peak along the longitudinal axis is equal to a third distal peak distance between the third distal end and the third peak along the longitudinal axis.

8. The screwcap of claim 1, wherein the third maximum outer diameter is greater than the nominal outer diameter by at least 0.5 mm.

9. The screwcap of claim 1, wherein the first maximum outer diameter, the second maximum outer diameter, and the third maximum outer diameter are equal to one another.

10. The screwcap of claim 1, wherein:

the first support ring has a first length along the longitudinal axis;

the second support ring has a second length along the longitudinal axis;

the third support ring has a third length along the longitudinal axis; and the third length is less than each of the first length and the second length.

11. The screwcap of claim 1, wherein the third support ring has a symmetric shape along the longitudinal axis.

12. The screwcap of claim 1, wherein the third support ring has a V-shaped cross-section along the longitudinal axis.

13. The screwcap of claim 1, wherein each of the first and second support rings has a curved cross-sectional shape.

14. The screwcap of claim 1, wherein the shell has an average thickness of 0.25 mm.

15. The screwcap of claim 1, wherein the head comprises at least one internal thread configured to engage with at least one external thread of the neck.

16. The screwcap of claim 1, further comprising an insert disposed between the shell and the neck, wherein the insert comprises at least one internal thread configured to engage with at least one external thread of the neck.

17. The screwcap of claim 1, further comprising a plurality of bridges disposed along the bridge line and detachably connecting the head to the skirt, wherein the plurality of bridges defines a plurality of perforations therebetween.

18. The screwcap of claim 1, further comprising a sealing arrangement disposed between the shell and the neck, wherein the sealing arrangement is configured to seal an opening of the neck.

19. A bottle assembly comprising:

a bottle comprising a neck, the neck comprising a shoulder and an opening; and a screwcap, the screwcap comprising:

a shell extending along a longitudinal axis and configured to be disposed on the neck, the shell comprising:

a head; and a skirt having a nominal outer diameter and detachably connected to the head along a bridge line, the skirt comprising:

a first support ring disposed proximal to the bridge line, the first support ring having a first maximum outer diameter greater than the nominal outer diameter of the skirt;

a second support ring disposed distal to the bridge line, the second support ring having a second maximum outer diameter greater than the nominal outer diameter of the skirt; and a third support ring disposed between the first support ring and the second support ring relative to the longitudinal axis, the third support ring having a third maximum outer diameter greater than the nominal outer diameter of the skirt;

wherein the shell is crimped to the neck, such that at least a portion of the third support ring deforms and engages the shoulder of the neck after crimping, wherein the third support ring has a third maximum crimped outer diameter after crimping, and wherein the third maximum crimped outer diameter is less than the nominal outer diameter of the skirt.

* * * * *